US009646537B2

(12) United States Patent
Lai et al.

(10) Patent No.: US 9,646,537 B2
(45) Date of Patent: May 9, 2017

(54) ORGANIC LIGHT EMITTING DIODE DISPLAY PANEL STRUCTURE AND DRIVING MECHANISM

(71) Applicant: HON HAI PRECISION INDUSTRY CO., LTD., New Taipei (TW)

(72) Inventors: Chung-Wen Lai, New Taipei (TW); Sheng-Han Li, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/814,629

(22) Filed: Jul. 31, 2015

(65) Prior Publication Data

US 2016/0125810 A1 May 5, 2016

(30) Foreign Application Priority Data

Oct. 30, 2014 (TW) ..... 103137690 A

(51) Int. Cl.

| | |
|---|---|
| ***G09G 3/32*** | (2016.01) |
| ***G09G 3/3258*** | (2016.01) |
| ***G09G 3/3275*** | (2016.01) |

(52) U.S. Cl.

CPC ..... *G09G 3/3258* (2013.01); *G09G 3/3275* (2013.01); *G09G 2300/08* (2013.01); *G09G 2320/0219* (2013.01); *G09G 2330/12* (2013.01); *G09G 2360/16* (2013.01)

(58) Field of Classification Search

CPC ..... G09G 3/3258; G09G 3/3266; G09G 2300/08; G09G 3/3275; G09G 2320/0219; G09G 2360/16; G09G 2330/12; G09G 3/32

See application file for complete search history.

(56) References Cited

U.S. PATENT DOCUMENTS

| | | | | |
|---|---|---|---|---|
| 9,076,387 | B1 * | 7/2015 | Lee | G09G 3/20 |
| 9,129,554 | B2 | 9/2015 | Kim et al. | |
| 2005/0264500 | A1 * | 12/2005 | Shirasaki | G09G 3/3225 345/77 |
| 2013/0257914 | A1 * | 10/2013 | Jung | G09G 3/348 345/690 |
| 2015/0002502 | A1 * | 1/2015 | Kim | G09G 3/3233 345/212 |

FOREIGN PATENT DOCUMENTS

| | | |
|---|---|---|
| TW | 201329941 | 7/2013 |

* cited by examiner

*Primary Examiner* — MD Saiful A Siddiqui
(74) *Attorney, Agent, or Firm* — Steven Reiss

(57) ABSTRACT

An organic light emitting diode display panel structure includes a number of pixel units and at least one performance enhancing unit. The pixels are arranged in a number of rows and columns. Each pixel unit receives a corresponding data signal. The performance enhancing unit receives performance information corresponding to the data signals of the pixel units, and calculates an enhanced data signal according to the performance information. Each pixel unit operates in a number of time events repeating in sequence. The time events are set by a time controller. A portion of the time events any two adjacent rows of pixel units overlaps. Each pixel unit emits light according to the enhanced data signal.

17 Claims, 4 Drawing Sheets

ORGANIC LIGHT EMITTING DIODE DISPLAY PANEL STRUCTURE AND DRIVING MECHANISM

FIELD

The subject matter herein generally relates to organic light emitting diode (OLED) display panels, and more particularly to an OLED pixel unit structure and a driving mechanism of the OLED pixel unit structure.

BACKGROUND

Generally, organic light emitting diodes (OLED) used in OLED display panels are classified as active matrix OLEDs (AMOLEDs) or passive matrix OLEDs (PMOLEDs). AMOLED display panels may include a driving transistor and a storage capacitor. The storage capacitor stores a data signal. The driving transistor provides a driving current to the OLED to emit light according to the data signal stored in the storage capacitor.

BRIEF DESCRIPTION OF THE DRAWINGS

Implementations of the present technology will now be described, by way of example only, with reference to the attached figures.

DETAILED DESCRIPTION

Figure 1:
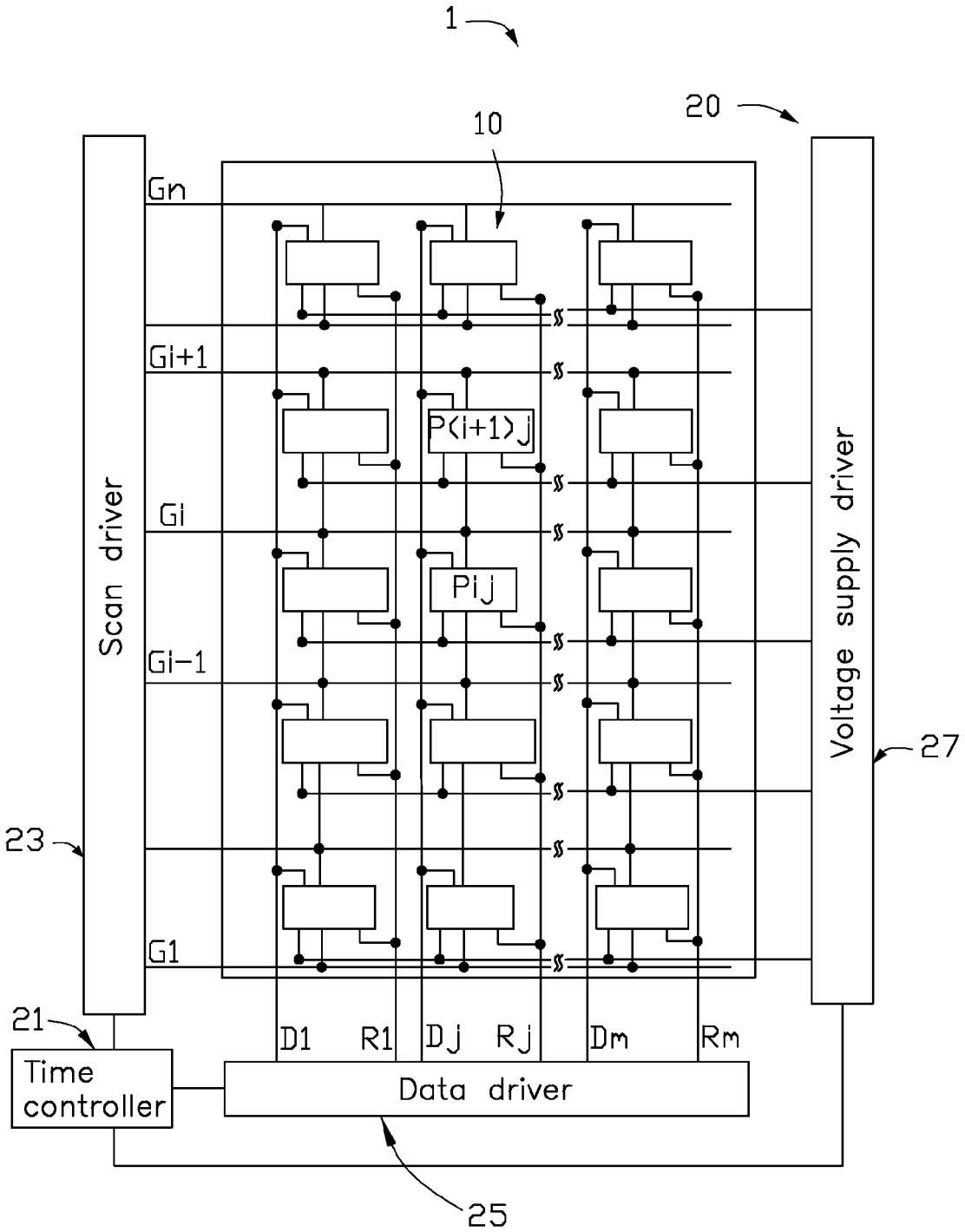
FIG. 1 is a diagram of an embodiment of an organic light emitting diode (OLED) display panel structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates an embodiment of an organic light emitting diode (OLED) display panel 1. The OLED display panel 1 can include a plurality of pixel units 10, a scan driver

Figure 2:
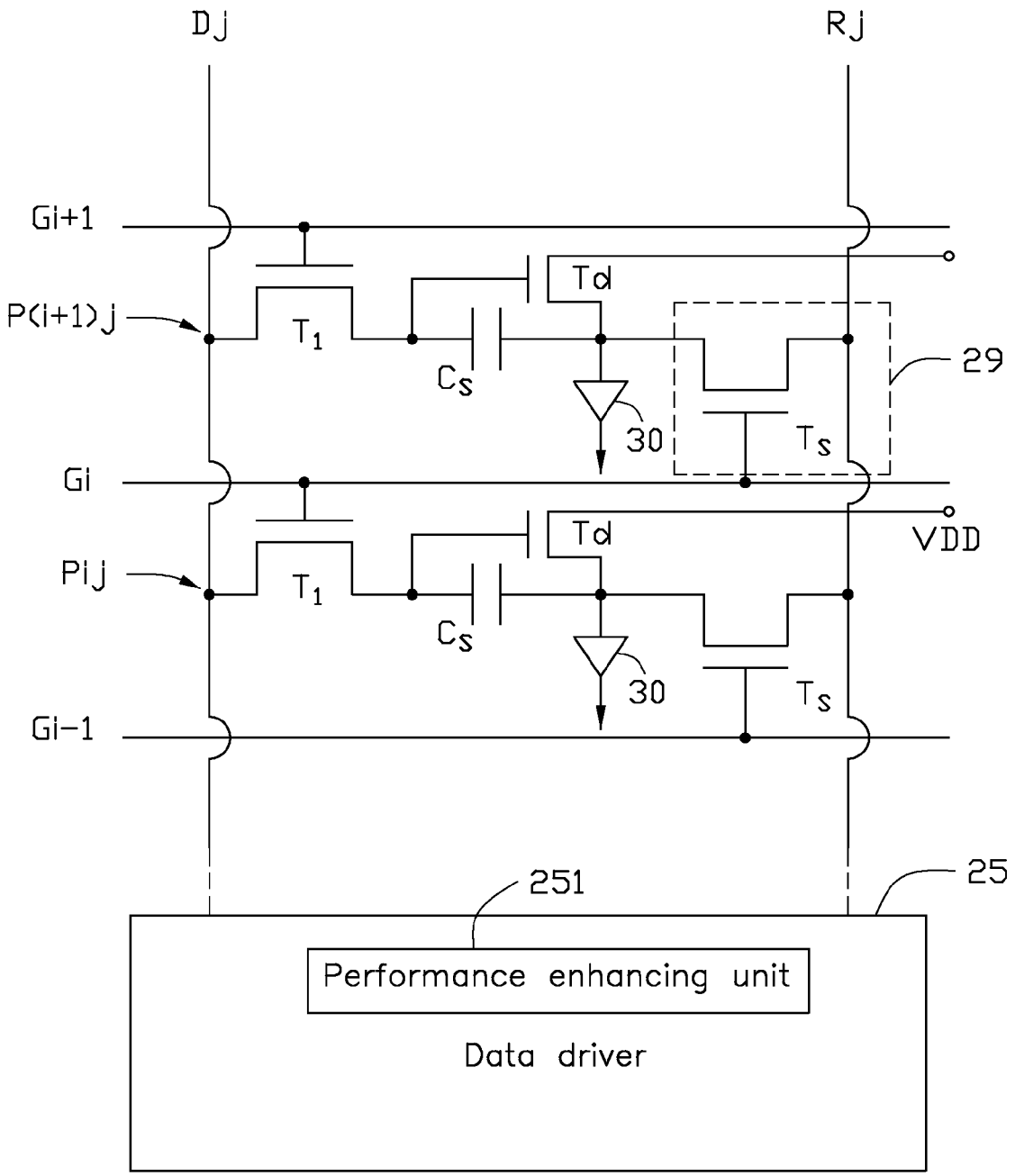
FIG. 2 is a diagram of an embodiment of a pixel unit structure of the OLED display panel structure of FIG. 1.

23, a data driver 25, a voltage supply driver 27, a time controller 21, and at least one performance enhancing unit 251 (shown in FIG. 2). The pixel units 10 can be arranged in a plurality of rows and a plurality of columns. A plurality of scan lines G1-Gn can extend from the scan driver 23. The scan driver 23 can generate scan signals, and each scan line can transmit the scan signals to corresponding pixel units 10 arranged along the scan line. A plurality of data lines D1-Dm can extend from the data driver 25. The data driver 25 can generate data signals, and each data line can transmit the data signals to corresponding pixel units 10 arranged along the data line. A plurality of voltage lines (not labeled) can extend from the voltage supply driver 27. The voltage supply driver 27 can generate a driving voltage VDD (shown in FIG. 2), and each voltage line can transmit the driving voltage to corresponding pixel units 10 arranged along the voltage line. A plurality of reading lines R1-Rm can extend from the performance enhancing unit 251. Each reading line can receive performance information Is (shown in FIG. 3) of corresponding pixel units 10 arranged along the reading line and transmit the performance information Is to the performance enhancing unit 251. In at least one embodiment, the performance enhancing unit 251 is a part of the data driver 25. In another embodiment, the performance enhancing unit 251 can be spatially separated from and electrically coupled to the data driver 25.

The performance enhancing unit 251 can calculate enhanced data signals according to the corresponding performance information Is, and the enhanced data signals can be transmitted to the corresponding pixel units 10 to improve a display quality of the pixel units 10. In at least one embodiment, the performance information Is of the pixel units 10 is a driving current according to the data signal. In at least one embodiment, each pixel unit 10 operates in a plurality of time events repeating in sequence. The plurality of time events can be set by a time controller 21 electrically coupled to the scan driver 23, the data driver 25, and the voltage supply driver 27. The time controller 21 can transmit a coordinating signal to the scan driver 23, the data driver 25, and the voltage supply driver 27 to set the plurality of time events. In at least one embodiment, a portion of the plurality of time events of any two adjacent rows of pixel units 10 overlaps.

As illustrated in FIG. 2, each pixel unit 10 can include a switch transistor T1, a storage capacitor Cs, a driving capacitor Td, an organic light emitting diode (OLED) 30, and a data circuit 29. The data circuit 29 can include a data transistor Ts electrically coupled to the corresponding reading line. The switch transistor T1 can receive the corresponding scan signal, the corresponding data signal, and the corresponding enhanced data signal. The storage capacitor Cs can receive the data signal and the enhanced data signal from the switch transistor T1. The driving transistor Td can output a driving current Id (shown in FIG. 3) according to the data signal and to the enhanced data signal. When the data transistor Ts is in a conducting state, the driving transistor Td outputs the driving current Id according to the data signal to the OLED 30 and to the data transistor Ts, and the OLED 30 emits light according to the data signal. When the data transistor Ts is in a non-conducting state, the driving transistor Td outputs the driving current Id according to the enhanced data signal to the OLED 30, and the OLED 30 emits light according to the enhanced data signal.

One data line Dj and one reading line Rj define one column of pixel units 10. Each scan line transmits the scan signal to the switch transistor T1 of a first pixel unit P(i+1)j of the pixel group, and transmits the scan signal to the data transistor Ts of a second pixel unit Pij of the pixel group. Any two adjacent pixel units 10 of one column of pixel units 10 constitute a pixel group. Any three adjacent scan lines define one pair of rows of adjacent pixel units 10. The three adjacent scan lines include a first scan line Gi+1 for transmitting the scan signal to the switch transistor T1 of the first pixel unit P(i+1)j of the pixel group, a second scan line Gi for transmitting the scan signal to the switch transistor T1 of the second pixel unit Pij and to the data transistor Ts of the first pixel unit P(i+1)j, and a third scan line Gi−1 for transmitting the scan signal to the data transistor Ts of the second pixel unit Pij of the pixel group. For each pixel unit 10, the data transistor Ts receives the scan signal before the switch transistor T1. Of the three adjacent scan lines, the third scan line Gi−1 transmits the scan signal before the second scan line Gi, and the second scan line Gi transmits the scan signal before the first scan line Gi+1.

A gate electrode of the switch transistor T1 is electrically coupled to the corresponding scan line to receive the scan signal. A source electrode of the switch transistor T1 is electrically coupled to the corresponding data line to receive the data signal and the enhanced data signal. A drain electrode of the switch transistor T1 is electrically coupled to the storage capacitor Cs to relay the data signal and the enhanced data signal to the storage capacitor Cs.

A gate electrode of the driving transistor Td is electrically coupled to the drain electrode of the switch transistor T1 to receive the data signal and the enhanced data signal. A source electrode of the driving transistor Td is electrically coupled to the corresponding voltage line to receive the driving voltage VDD from the voltage supply driver 27. A drain electrode of the driving transistor Td is electrically coupled to the OLED 30 and the data transistor Ts.

A gate electrode of the data transistor Ts is electrically coupled to the corresponding scan line to receive the scan signal. A source electrode of the data transistor Ts is electrically coupled to the driving transistor Td. A drain electrode of the data transistor Ts is electrically coupled to the corresponding reading line to transmit the performance information Is to the performance enhancing unit 251.

In at least one embodiment, one performance enhancing unit 251 can calculate the enhanced data signal for all of the pixel units 10. In another embodiment, a plurality of performance enhancing units 251 can calculate the enhanced data signals for the pixel units 10. For example, one performance enhancing unit 251 can calculate the enhanced data signals for one column of pixel units 10.

Figure 3:
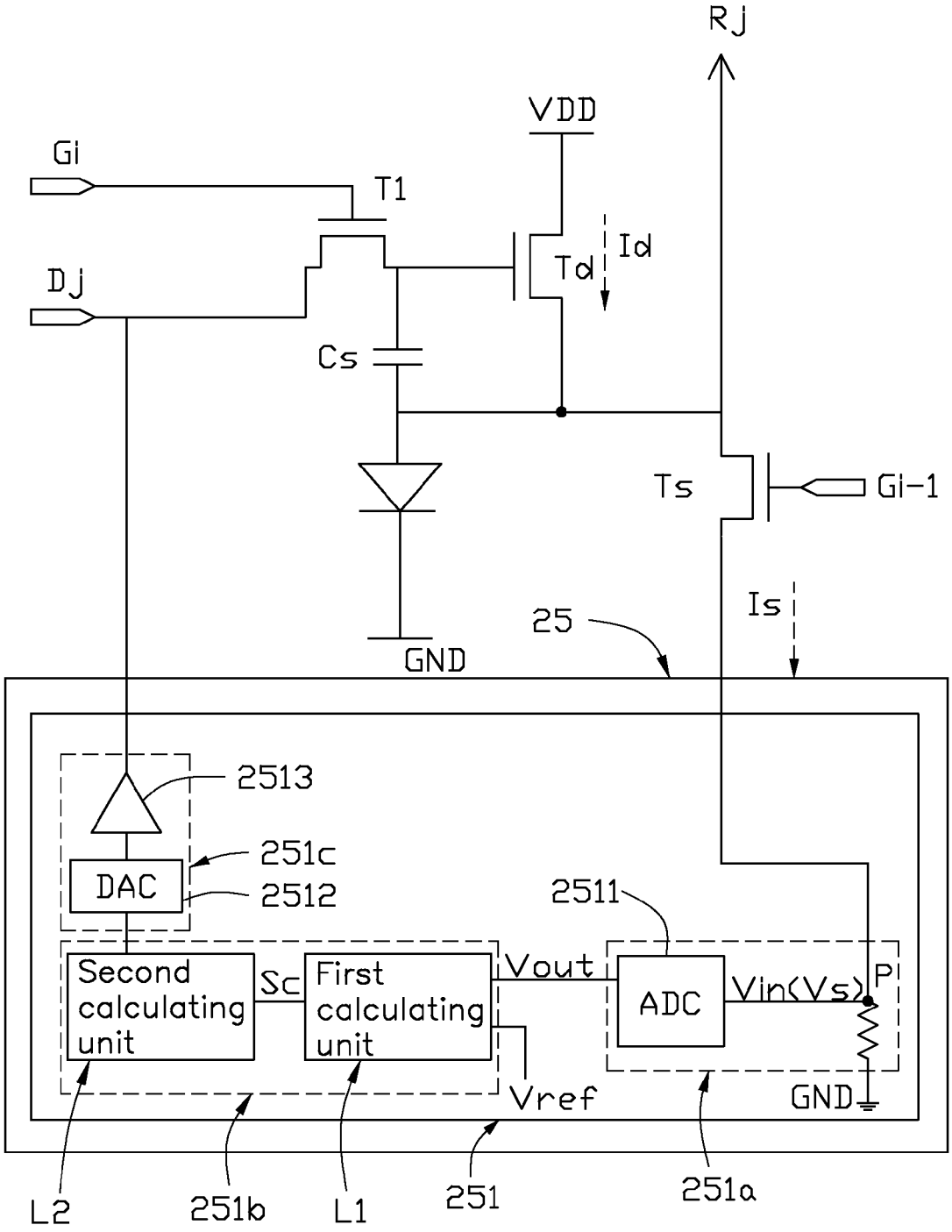
FIG. 3 is a circuit diagram of an embodiment of a performance enhancing unit of FIG. 2.

As illustrated in FIG. 3, the performance enhancing unit 251 can include a first conversion unit 251*a*, an enhancing unit 251*b*, and a second conversion unit 251*c*. The first conversion unit 251*a* is electrically coupled to the reading line Rj to receive the performance information Is. The first conversion unit 251*a* can convert the performance information Is from an analog signal to a digital signal and transmit the performance information Is to the enhancing unit 251*b*. The enhancing unit 251*b* can calculate an enhancing value according to the performance information Is, calculate the enhanced data signal according to the enhancing value, and transmit the enhanced data signal to the second conversion unit 251*c*. The second conversion unit 251*c* can convert the enhanced data signal from the digital signal to the analog signal. The data driver 25 can transmit the enhanced data signal to the corresponding pixel unit 10.

The first conversion unit 251*a* can include a transfer resistor (not labeled) and an analog/digital converter (ADC) 2511. The transfer resistor is electrically coupled between the reading line Rj and a ground terminal GND. The transfer resistor converts the performance information Is into a reading voltage Vs. A node P is electrically coupled between the reading line Rj and the transfer resistor. The ADC 2511 comprises an input terminal Vin electrically coupled to the node P, and an output terminal Vout electrically coupled to the enhancing unit 251*b*. The input terminal Vin receives the reading voltage Vs from the node P. The ADC 2511 converts the reading voltage Vs into the digital signal. The output terminal Vout transmits the reading voltage Vs to the enhancing unit 251*b*.

The enhancing unit 251*b* can include a first calculating unit L1 and a second calculating unit L2. The first calculating unit L1 compares the reading voltage Vs to a reference voltage Vref by subtracting the reading voltage Vs from the reference voltage Vref to obtain an enhancing signal Sc. The reference voltage Vref is a default voltage of the driving transistor Td corresponding to the driving current Id. The second calculating unit L2 compares the enhancing signal Sc to the data signal transmitted to the pixel unit 10 by subtracting the data signal from the enhancing signal Sc to obtain a signal difference value. The enhanced data signal is equal to a sum of the data signal and the signal difference value.

The second conversion unit 251*c* can include a digital/analog converter (DAC) 2512 and a temporary storage 2513. The DAC 2512 converts the enhanced data signal from the digital signal to the analog signal and transmits the enhanced data signal to the temporary storage 2513. The temporary storage 2513 temporarily stores the enhanced data signal and transmits the enhanced data signal to the data line Dj.

Figure 4:
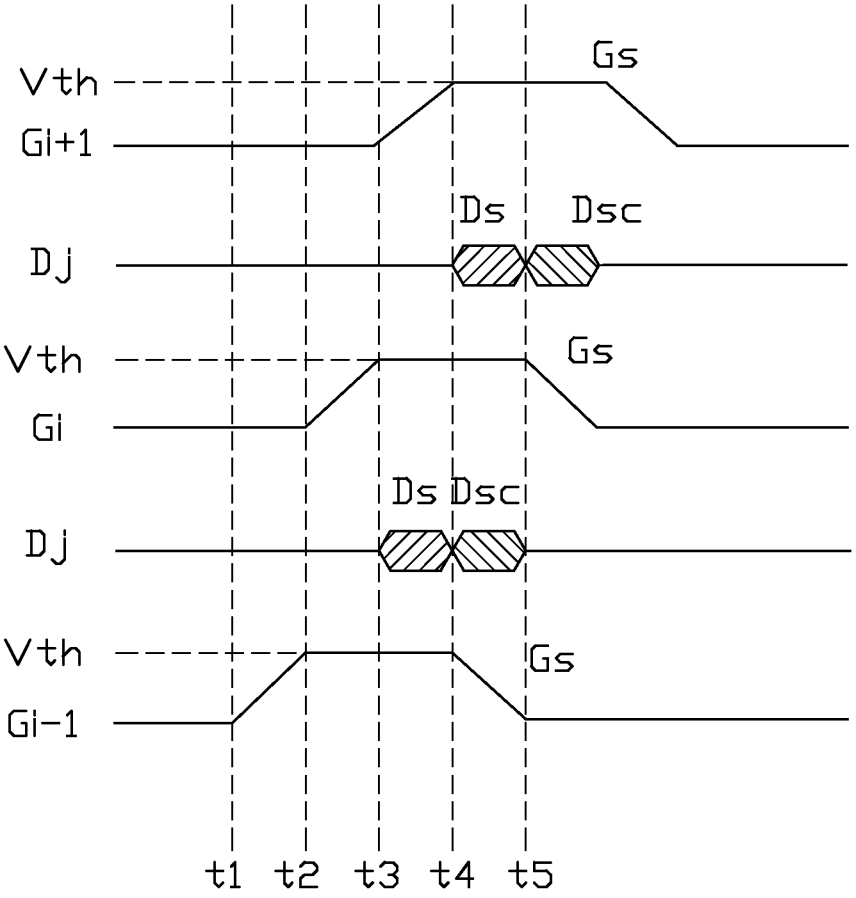
FIG. 4 is a driving sequence diagram of the pixel unit structure of FIG. 2.

As illustrated in FIG. 4, the plurality of pixel units 10 can operate in five time events repeating in sequence. For simplicity and clarity of illustration, the five time events of the pixel group in FIG. 2 will be described.

At a first time event of the pixel group, the scan signal (i.e., Gs) is transmitted along the third scan line Gi−1 to the data transistor Ts of the second pixel unit Pij.

At a second time event of the pixel group, a voltage level of the scan signal received by the data transistor Ts of the second pixel unit Pij reaches a threshold voltage level Vth of the data transistor Ts, thereby causing the data transistor Ts to be in the conducting state. The scan signal is transmitted along the second scan line Gi to the switch transistor T1 of the second pixel unit Pij and to the data transistor Ts of the first pixel unit P(i+1)j.

At a third time event of the pixel group, a voltage of the scan signal received by the switch transistor T1 of the second pixel unit Pij reaches a threshold voltage Vth of the switch transistor T1, thereby causing the switch transistor T1 to be in a conducting state. The data signal (i.e., Ds) is transmitted to the switch transistor T1 of the second pixel unit Pij. The data signal is relayed from the switch transistor T1 of the second pixel unit Pij to the gate electrode of the corresponding driving transistor Td and to the corresponding storage capacitor. The data signal causes the driving transistor Td of the second pixel unit Pij to be in a conducting state to receive the driving voltage Vdd from the voltage supply driver 27. The driving transistor Td of the second pixel unit Pij, upon receiving the driving voltage VDD, outputs the driving current Id to the corresponding OLED 30, and the OLED 30 emits light according to the data signal upon receiving the driving current Id. The data transistor Ts of the second pixel unit Pij receives the driving current Id and transmits the performance information Is along the reading line Rj to the performance enhancing unit 251. The scan signal received by the data transistor Ts of the first pixel unit P(i+1)j reaches a threshold voltage Vth of the data transistor Ts to cause the data transistor Ts of the first pixel unit P(i+1)j to be in the conducting state. The scan signal is transmitted along the first scan line Gi+1 to the switch transistor T1 of the first pixel unit P(i+1)j.

At a fourth time event of the pixel group, the scan signal received by the data transistor Ts of the second pixel unit Pij falls below the threshold voltage Vth of the data transistor Ts, thereby causing the data transistor Ts to be in the non-conducting state and to stop transmitting the performance information Is to the performance enhancing unit 251. The corresponding enhanced data signal (Dsc) is transmitted along the data line Dj to the switch transistor T1 of the second pixel unit Pij. The enhanced data signal is relayed to the OLED 30 through the corresponding storage capacitor Cs. The OLED 30 of the second pixel unit Pij emits light according to the enhanced data signal. The scan signal received by the switch transistor T1 of the first pixel unit P(i+1)j reaches a threshold voltage Vth of the switch transistor T1 to cause the switch transistor T1 to be in a conducting state. The corresponding data signal is transmitted to the switch transistor T1 of the first pixel unit P(i+1)j. The data signal is relayed from the switch transistor T1 of the first pixel unit P(i+1)j to the gate electrode of the corresponding driving transistor Td and to the corresponding storage capacitor Cs. The data signal causes the driving transistor Td of the first pixel unit P(i+1)j to be in a conducting state to receive the driving voltage VDD from the voltage supply driver 27. The driving transistor Td of the first pixel unit P(i+1)j upon receiving the driving voltage VDD outputs the driving current Id to the corresponding OLED 30, and the OLED 30 emits light according to the data signal upon receiving the driving current Id. The data transistor Ts of the first pixel unit P(i+1)j receives the driving current Id and transmits the performance information Is along the reading line Rj to the performance enhancing unit 251.

At a fifth time event of the pixel group, the scan signal received by the data transistor Ts of the first pixel unit P(i+1)j falls below the threshold voltage Vth of the data transistor Ts, thereby causing the data transistor Ts to be in the non-conducting state and to stop transmitting the performance information Is to the performance enhancing unit 251. The corresponding enhanced data signal is transmitted along the data line Dj to the switch transistor T1 of the first pixel unit P(i+1)j. The enhanced data signal is relayed to the corresponding OLED 30 through the corresponding storage capacitor Cs. The OLED 30 of the first pixel unit P(i+1)j emits light according to the enhanced data signal.

By using the performance enhancing unit 251, a display quality of the OLED display panel 1 can be improved.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An organic light emitting diode display panel structure comprising:

a plurality of pixel units arranged in rows and columns;

a scan driver configured to generate scan signals for the plurality of pixel units;

a plurality of scan lines extending from the scan driver, each of the plurality of scan lines configured to transmit the scan signals to two rows of pixel units arranged adjacent to the scan line;

a data driver configured to generate, upon receiving the scan signals, data signals for the plurality of pixel units;

a plurality of data lines extending from the data driver, each of the plurality of data lines configured to transmit the data signals to a corresponding column of the plurality of pixel units arranged along the data line;

a plurality of reading lines extending from the data driver, each of the plurality of reading lines configured to receive performance information from a corresponding column of the plurality of pixel units arranged along the reading line and transmit the performance information to the data driver to analyze;

a voltage supply driver configured to generate a driving voltage for the plurality of pixel units;

a plurality of voltage lines extending from the voltage supply driver, each of the plurality of voltage lines configured to transmit the driving voltage to a corresponding row of the plurality of pixel units arranged along the voltage line; and a time controller configured to transmit a coordinating signal to the scan driver, the data driver, and the voltage supply driver to control the scan driver, the data driver, and the voltage supply driver to transmit the scan signals, the data signals, and the driving voltages, respectively;

wherein the scan signals transmitted along one scan line of the plurality of scan lines are transmitted to the adjacent rows of the plurality of pixel units arranged along the scan line;

wherein each pixel unit operates in a plurality of time events repeating in sequence, the plurality of time events set by the coordinating signal of the time controller;

wherein a portion of the plurality of time events of the two adjacent rows of the plurality of pixel units overlaps;

wherein the data driver calculates an enhanced data signal for each of the plurality of pixel units according to the corresponding performance information, and transmits the enhanced data signals along the corresponding data lines to the plurality of pixel units; and wherein each of the plurality of pixel units emits light corresponding to the data signal and the enhanced data signal;

wherein each pixel unit comprises:

a switch transistor configured to receive the corresponding scan signal, the corresponding data signal, and the corresponding enhanced data signal;

a storage capacitor configured to receive the data signal and the enhanced data signal from the switch transistor;

a driving transistor configured to output a driving current corresponding to the data signal and to the enhanced data signal;

an organic light emitting diode configured to emit light corresponding to the enhanced data signal upon receiving the corresponding driving current; and a data circuit configured to transmit the performance information to the data driver;

wherein the data circuit comprises a data transistor electrically coupled to the corresponding reading line;

the performance information is the driving current, corresponding to the data signal, output by the driving transistor;

one data line and one reading line define one column of pixel units;

any three adjacent scan lines define one pair of rows of adjacent pixel units;

any two adjacent pixel units of one column of pixel units constitute a pixel group;

each scan line is configured to transmit the scan signal to the switch transistor of a first pixel unit of the pixel group, and transmit the scan signal to the data transistor of a second pixel unit of the pixel group;

the three adjacent scan lines comprise a first scan line configured to transmit the scan signal to the switch transistor of the first pixel unit of the pixel group, a second scan line configured to transmit the scan signal to the switch transistor of the second pixel unit and to the data transistor of the first pixel unit of the pixel group, and a third scan line configured to transmit the scan signal to the data transistor of the second pixel unit of the pixel group;

for each pixel unit, the data transistor receives the scan signal before the switch transistor; and of the three adjacent scan lines, the third scan line transmits the scan signal before the second scan line, and the second scan line transmits the scan signal before the first scan line.

2. The organic light emitting diode display panel structure as in claim 1, wherein:

a gate electrode of the switch transistor is electrically coupled to the corresponding scan line to receive the scan signal;

a source electrode of the switch transistor is electrically coupled to the corresponding data line to receive the data signal and the enhanced data signal;

a drain electrode of the switch transistor is electrically coupled to the storage capacitor;

a gate electrode of the driving transistor is electrically coupled to the drain electrode of the switch transistor to receive the data signal and the enhanced data signal;

a source electrode of the driving transistor is electrically coupled to the corresponding voltage line to receive the driving voltage from the voltage supply driver;

a drain electrode of the driving transistor is electrically coupled to the organic light emitting diode and the data transistor;

a gate electrode of the data transistor is electrically coupled to the corresponding scan line to receive the scan signal;

a source electrode of the data transistor is electrically coupled to the driving transistor; and a drain electrode of the data transistor is electrically coupled to the corresponding reading line to transmit the performance information to the data driver.

3. The organic light emitting diode display panel structure as in claim 2, wherein:

the data driver comprises at least one performance enhancing unit configured to calculate the enhanced data signals according to the corresponding performance information;

the performance enhancing unit comprises a first conversion unit, an enhancing unit, and a second conversion unit;

the first conversion unit is electrically coupled to the reading line to receive the performance information;

the first conversion unit converts the performance information from an analog signal to a digital signal, and transmits the performance information to the enhancing unit;

the enhancing unit calculates an enhancing value according to the performance information, calculates the enhanced data signal according to the enhancing value, and transmits the enhanced data signal to the second conversion unit;

the second conversion unit converts the enhanced data signal from the digital signal to the analog signal; and the data driver transmits the enhanced data signal to the corresponding pixel unit.

4. The organic light emitting diode display panel structure as in claim 3, wherein:

the first conversion unit comprises a transfer resistor and an analog/digital converter;

the transfer resistor is electrically coupled between the reading line and a ground terminal;

the transfer resistor converts the performance information into a reading voltage;

a node is electrically coupled between the reading line and the transfer resistor;

the analog/digital converter comprises an input terminal electrically coupled to the node, and an output terminal electrically coupled to the enhancing unit;

the input terminal receives the reading voltage from the node;

the analog/digital converter converts the reading voltage into the digital signal;

the output terminal transmits the reading voltage to the enhancing unit;

the enhancing unit comprises a first calculating unit and a second calculating unit;

the first calculating unit compares the reading voltage to a reference voltage by subtracting the reading voltage from the reference voltage to obtain an enhancing signal;

the reference voltage is a default voltage of the driving transistor corresponding to the driving current;

the second calculating unit compares the enhancing signal to the data signal transmitted to the pixel unit by subtracting the data signal from the enhancing signal to obtain a signal difference value;

the enhanced data signal is equal to a sum of the data signal and the signal difference value;

the second conversion unit comprises a digital/analog converter and a temporary storage;

the digital/analog converter converts the enhanced data signal from the digital signal to the analog signal and transmits the enhanced data signal to the temporary storage; and the temporary storage temporarily stores the enhanced data signal and transmits the enhanced data signal to the data line.

5. The organic light emitting diode display panel structure as in claim 4, wherein at a first time event of the pixel group, the scan signal is transmitted along the third scan line to the data transistor of the second pixel unit.

6. The organic light emitting diode display panel structure as in claim 5, wherein at a second time event of the pixel group:

a voltage level of the scan signal received by the data transistor of the second pixel unit reaches a threshold voltage level of the data transistor;

the data transistor is in a conducting state; and the scan signal is transmitted along the second scan line to the switch transistor of the second pixel unit and to the data transistor of the first pixel unit.

7. The organic light emitting diode display panel structure as in claim 6, wherein at a third time event of the pixel group:

a voltage of the scan signal received by the switch transistor of the second pixel unit reaches a threshold voltage of the switch transistor;

the data signal is transmitted to the switch transistor of the second pixel unit;

the data signal is relayed from the switch transistor of the second pixel unit to the gate electrode of the corresponding driving transistor and to the corresponding storage capacitor;

the data signal causes the driving transistor of the second pixel unit to be in a conducting state to receive the driving voltage from the voltage supply driver;

the driving transistor of the second pixel unit upon receiving the driving voltage outputs the driving current to the corresponding organic light emitting diode, and the organic light emitting diode emits light corresponding to the data signal upon receiving the driving current;

the data transistor of the second pixel unit receives the driving current and transmits the performance information along the reading line to the performance enhancing unit;

the scan signal received by the data transistor of the first pixel unit reaches a threshold voltage of the data transistor to cause the data transistor of the first pixel unit to be in a conducting state; and the scan signal is transmitted along the first scan line to the switch transistor of the first pixel unit.

8. The organic light emitting diode display panel structure as in claim 7, wherein at a fourth time event of the pixel group:

the scan signal received by the data transistor of the second pixel unit falls below the threshold voltage of the data transistor, thereby causing the data transistor to be in a non-conducting state and to stop transmitting the performance information to the performance enhancing unit;

the corresponding enhanced data signal is transmitted along the data line to the switch transistor of the second pixel unit;

the enhanced data signal is relayed to the organic light emitting diode through the corresponding storage capacitor;

the organic light emitting diode of the second pixel unit emits light corresponding to the enhanced data signal;

the scan signal received by the switch transistor of the first pixel unit reaches a threshold voltage of the switch transistor to cause the switch transistor to be in a conducting state;

the corresponding data signal is transmitted to the switch transistor of the first pixel unit;

the data signal is relayed from the switch transistor of the first pixel unit to the gate electrode of the corresponding driving transistor and to the corresponding storage capacitor;

the data signal causes the driving transistor of the first pixel unit to be in a conducting state to receive the driving voltage from the voltage supply driver;

the driving transistor of the first pixel unit upon receiving the driving voltage outputs the driving current to the corresponding organic light emitting diode; and the data transistor of the first pixel unit receives the driving current and transmits the performance information along the reading line to the performance enhancing unit.

9. The organic light emitting diode display panel structure as in claim 8, wherein at a fifth time event of the pixel group:

the scan signal received by the data transistor of the first pixel unit falls below the threshold voltage of the data transistor, thereby causing the data transistor to be in a non-conducting state and to stop transmitting the performance information to the performance enhancing unit;

the corresponding enhanced data signal is transmitted along the data line to the switch transistor of the first pixel unit;

the enhanced data signal is relayed to the corresponding organic light emitting diode through the corresponding storage capacitor; and the organic light emitting diode of the first pixel unit emits light according to the enhanced data signal.

10. An organic light emitting diode display panel structure comprising:

a plurality of pixel units arranged in rows and columns, each of the plurality of pixel units configured to receive a corresponding data signal; and at least one performance enhancing unit configured to receive performance information corresponding to the data signals of the plurality of pixel units, and calculate an enhanced data signal according to the performance information for the plurality of pixel units;

wherein each of the plurality of pixel units operates in a plurality of time events repeating in sequence, the plurality of time events set by a time controller;

wherein a portion of the plurality of time events of the pixel units of any two adjacent rows of pixel units overlaps; and wherein each of the plurality of pixel units emits light corresponding to the enhanced data signal;

wherein each pixel unit comprises:

a switch transistor configured to receive a corresponding scan signal to be in a conducting state, and receive the corresponding data signal and the corresponding enhanced data signal when in the conducting state;

a storage capacitor configured to receive the data signal and the enhanced data signal from the switch transistor;

a driving transistor configured to output a driving current corresponding to the data signal and to the enhanced data signal;

an organic light emitting diode configured to emit light corresponding to the enhanced data signal upon receiving the corresponding driving current; and a data circuit configured to transmit the performance information to the data driver;

wherein the data circuit comprises a data transistor electrically coupled to the corresponding reading line;

the performance information is the driving current, corresponding to the data signal, output by the driving transistor;

each column of pixel units is defined by one data line and one reading line, the data line configured to transmit the data signal and the enhanced data signal from a data driver to the corresponding pixel units, and the reading line configured to transmit the performance information of the corresponding pixel units to the performance enhancing unit;

any two adjacent pixel units of the column constitute a pixel group and are defined by three adjacent scan lines, each scan line configured to transmit the scan signal from a scan driver to the corresponding pixel units;

each scan line is configured to transmit the scan signal to the switch transistor of a first pixel unit of the pixel group, and transmit the scan signal to the data transistor of a second pixel unit of the pixel group;

the three adjacent scan lines defining each pixel group comprise a first scan line configured to transmit the scan signal to the switch transistor of the first pixel unit of the pixel group, a second scan line configured to transmit the scan signal to the switch transistor of the second pixel unit and to the data transistor of the first pixel unit of the pixel group, and a third scan line configured to transmit the scan signal to the data transistor of the second pixel unit of the pixel group;

for each pixel unit, the data transistor receives the scan signal before the switch transistor; and of the three adjacent scan lines, the third scan line transmits the scan signal before the second scan line, and the second scan line transmits the scan signal before the first scan line.

11. The organic light emitting diode display panel structure as in claim 10, wherein:

a gate electrode of the switch transistor is electrically coupled to the corresponding scan line to receive the scan signal;

a source electrode of the switch transistor is electrically coupled to the corresponding data line to receive the data signal and the enhanced data signal;

a drain electrode of the switch transistor is electrically coupled to the storage capacitor;

a gate electrode of the driving transistor is electrically coupled to the drain electrode of the switch transistor to receive the data signal and the enhanced data signal;

a source electrode of the driving transistor is electrically coupled to a corresponding voltage line to receive a driving voltage from a voltage supply driver;

a drain electrode of the driving transistor is electrically coupled to the organic light emitting diode and the data transistor;

a gate electrode of the data transistor is electrically coupled to the corresponding scan line to receive the scan signal;

a source electrode of the data transistor is electrically coupled to the driving transistor;

a drain electrode of the data transistor is electrically coupled to the corresponding reading line to transmit the performance information to the performance enhancing unit;

the performance enhancing unit comprises a first conversion unit, an enhancing unit, and a second conversion unit;

the first conversion unit is electrically coupled to the reading line to receive the performance information;

the first conversion unit converts the performance information from an analog signal to a digital signal, and transmits the performance information to the enhancing unit;

the enhancing unit calculates an enhancing value according to the performance information, calculates the enhanced data signal according to the enhancing value, and transmits the enhanced data signal to the second conversion unit;

the second conversion unit converts the enhanced data signal from the digital signal to the analog signal;

the second conversion unit is electrically coupled to the corresponding data line and transmits the enhanced data signal to the corresponding pixel unit;

the first conversion unit comprises a transfer resistor and an analog/digital converter;

the transfer resistor is electrically coupled between the reading line and a ground terminal;

the transfer resistor converts the performance information into a reading voltage;

a node is electrically coupled between the reading line and the transfer resistor;

the analog/digital converter comprises an input terminal electrically coupled to the node, and an output terminal electrically coupled to the enhancing unit;

the input terminal receives the reading voltage from the node;

the analog/digital converter converts the reading voltage into the digital signal;

the output terminal transmits the reading voltage to the enhancing unit;

the enhancing unit comprises a first calculating unit and a second calculating unit;

the first calculating unit compares the reading voltage to a reference voltage by subtracting the reading voltage from the reference voltage to obtain an enhancing signal;

the reference voltage is a default voltage of the driving transistor corresponding to the driving current;

the second calculating unit compares the enhancing signal to the data signal transmitted to the pixel unit by subtracting the data signal from the enhancing signal to obtain a signal difference value;

the enhanced data signal is equal to a sum of the data signal and the signal difference value;

the second conversion unit comprises a digital/analog converter and a temporary storage;

the digital/analog converter converts the enhanced data signal from the digital signal to the analog signal and transmits the enhanced data signal to the temporary storage; and the temporary storage is electrically coupled to the corresponding data line;

the temporary storage temporarily stores the enhanced data signal and transmits the enhanced data signal to the data line.

12. The organic light emitting diode display panel structure as in claim 11, wherein at a first time event of the pixel group, the scan signal is transmitted along the third scan line to the data transistor of the second pixel unit.

13. The organic light emitting diode display panel structure as in claim 12, wherein at a second time event of the pixel group:

a voltage level of the scan signal received by the data transistor of the second pixel unit reaches a threshold voltage level of the data transistor;

the data transistor is in a conducting state; and the scan signal is transmitted along the second scan line to the switch transistor of the second pixel unit and to the data transistor of the first pixel unit.

14. The organic light emitting diode display panel structure as in claim 13, wherein at a third time event of the pixel group:

a voltage of the scan signal received by the switch transistor of the second pixel unit reaches a threshold voltage of the switch transistor;

the data signal is transmitted to the switch transistor of the second pixel unit;

the data signal is relayed from the switch transistor of the second pixel unit to the gate electrode of the corresponding driving transistor and to the corresponding storage capacitor;

the data signal causes the driving transistor of the second pixel unit to be in a conducting state to receive the driving voltage from the voltage supply driver;

the driving transistor of the second pixel unit upon receiving the driving voltage outputs the driving current to the corresponding organic light emitting diode, and the organic light emitting diode emits light corresponding to the data signal upon receiving the driving current;

the data transistor of the second pixel unit receives the driving current and transmits the performance information along the reading line to the performance enhancing unit;

the scan signal received by the data transistor of the first pixel unit reaches a threshold voltage of the data transistor to cause the data transistor of the first pixel unit to be in a conducting state; and the scan signal is transmitted along the first scan line to the switch transistor of the first pixel unit.

15. The organic light emitting diode display panel structure as in claim 14, wherein at a fourth time event of the pixel group:

the scan signal received by the data transistor of the second pixel unit falls below the threshold voltage of the data transistor, thereby causing the data transistor to be in a non-conducting state and to stop transmitting the performance information to the performance enhancing unit;

the corresponding enhanced data signal is transmitted along the data line to the switch transistor of the second pixel unit;

the enhanced data signal is relayed to the organic light emitting diode through the corresponding storage capacitor;

the organic light emitting diode of the second pixel unit emits light corresponding to the enhanced data signal;

the scan signal received by the switch transistor of the first pixel unit reaches a threshold voltage of the switch transistor to cause the switch transistor to be in a conducting state;

the corresponding data signal is transmitted to the switch transistor of the first pixel unit;

the data signal is relayed from the switch transistor of the first pixel unit to the gate electrode of the corresponding driving transistor and to the corresponding storage capacitor;

the data signal causes the driving transistor of the first pixel unit to be in a conducting state to receive the driving voltage from the voltage supply driver;

the driving transistor of the first pixel unit upon receiving the driving voltage outputs the driving current to the corresponding organic light emitting diode; and the data transistor of the first pixel unit receives the driving current and transmits the performance information along the reading line to the performance enhancing unit.

16. The organic light emitting diode display panel structure as in claim 15, wherein at a fifth time event of the pixel group:

the scan signal received by the data transistor of the first pixel unit falls below the threshold voltage of the data transistor, thereby causing the data transistor to be in a non-conducting state and to stop transmitting the performance information to the performance enhancing unit;

the corresponding enhanced data signal is transmitted along the data line to the switch transistor of the first pixel unit;

the enhanced data signal is relayed to the corresponding organic light emitting diode through the corresponding storage capacitor; and the organic light emitting diode of the first pixel unit emits light according to the enhanced data signal.

17. An organic light emitting diode display panel structure comprising:

a plurality of pixel units arranged in a matrix;

a scan driver configured to generate scan signals;

a plurality of scan lines extending from the scan driver;

a data driver configured to generate data signals upon receiving the scan signals;

a plurality of data lines extending from the data driver;

a plurality of reading lines extending from the data driver, each of the plurality of reading lines configured to receive performance information from corresponding pixel units;

wherein the data driver calculates an enhanced data signal for each of the plurality of pixel units according to the corresponding performance information, and transmits the enhanced data signals along the corresponding data lines to the plurality of pixel units; and wherein each of the plurality of pixel units emits light corresponding to the data signal and the enhanced data signal;

wherein each of the plurality of pixel unit comprises:

a switch transistor configured to receive the corresponding scan signal, the corresponding data signal, and the corresponding enhanced data signal;

a storage capacitor configured to receive the data signal and the enhanced data signal from the switch transistor;

a driving transistor configured to output a driving current corresponding to the data signal and to the enhanced data signal;

an organic light emitting diode configured to emit light corresponding to the enhanced data signal upon receiving the corresponding driving current; and a data circuit configured to transmit the performance information to the data driver;

wherein the data circuit comprises a data transistor electrically coupled to the corresponding reading line;

the performance information is the driving current, corresponding to the data signal, output by the driving transistor;

one data line and one reading line define one column of pixel units;

any three adjacent scan lines define one pair of rows of adjacent pixel units;

any two adjacent pixel units of one column of pixel units constitute a pixel group;

each scan line is configured to transmit the scan signal to the switch transistor of a first pixel unit of the pixel group, and transmit the scan signal to the data transistor of a second pixel unit of the pixel group;

the three adjacent scan lines comprise a first scan line configured to transmit the scan signal to the switch transistor of the first pixel unit of the pixel group, a second scan line configured to transmit the scan signal to the switch transistor of the second pixel unit and to the data transistor of the first pixel unit of the pixel group, and a third scan line configured to transmit the scan signal to the data transistor of the second pixel unit of the pixel group;

for each pixel unit, the data transistor receives the scan signal before the switch transistor; and of the three adjacent scan lines, the third scan line transmits the scan signal before the second scan line, and the second scan line transmits the scan signal before the first scan line.

* * * * *